US005641724A

United States Patent [19]

Yamaguchi et al.

[11] Patent Number: 5,641,724

[45] Date of Patent: Jun. 24, 1997

[54] REVERSIBLE THERMOSENSITIVE COLORING COMPOSITION AND A THERMOSENSITIVE RECORDING MEDIUM USING THEREOF

[75] Inventors: Takehito Yamaguchi, Numazu; Kyoji Tsutsui, Mishima; Masaru Shimada, Shizuoka-ken, all of Japan

[73] Assignee: Ricoh Company, Ltd., Tokyo, Japan

[21] Appl. No.: 536,452

[22] Filed: Sep. 29, 1995

[30] Foreign Application Priority Data

Sep. 29, 1994 [JP] Japan ..... 6-234619
Sep. 21, 1995 [JP] Japan ..... 7-243507

[51] Int. Cl.[6] ..... B41M 5/035

[52] U.S. Cl. ..... 503/221; 427/151; 503/201; 503/209; 503/216; 503/217

[58] Field of Search ..... 106/21 R; 503/201, 503/217, 221, 216, 208, 209; 427/151

[56] References Cited

U.S. PATENT DOCUMENTS

| | | | |
|---|---|---|---|
| 4,628,337 | 12/1986 | Sekine | 503/217 |
| 4,880,768 | 11/1989 | Mochizuki et al. | 503/227 |
| 5,019,550 | 5/1991 | Suzuki et al. | 503/227 |
| 5,049,538 | 9/1991 | Mochizuki et al. | 503/227 |
| 5,143,893 | 9/1992 | Mochizuki et al. | 503/227 |
| 5,144,334 | 9/1992 | Suzuki et al. | 346/1.1 |
| 5,185,194 | 2/1993 | Miyake et al. | 428/64 |
| 5,380,693 | 1/1995 | Goto | 503/200 |
| 5,403,810 | 4/1995 | Sawamura et al. | 503/201 |

FOREIGN PATENT DOCUMENTS

| | | |
|---|---|---|
| 5124360 | 5/1993 | Japan . |
| 61066 | 1/1994 | Japan . |
| 6155907 | 6/1994 | Japan . |
| 6210954 | 8/1994 | Japan . |

*Primary Examiner*—Bruce H. Hess
*Attorney, Agent, or Firm*—Oblon, Spivak, McClelland, Maier & Neustadt, P.C.

[57] ABSTRACT

This invention generally relates to a reversible thermosensitive coloring composition and a thermosensitive recording medium using thereof which have high light-resisting characteristics, wherein coloring and decolorizing can be repeated suitably. A reversible thermosensitive coloring composition of this invention comprises an electron donating chromophoric compound and an electron accepting compound, which has a colored state and a decolorized state based on a heated temperature and a difference between cooling speeds after being heated, said electron donating chromophoric compound including a compound having a general formula (I)

(I)

6 Claims, 1 Drawing Sheet

REVERSIBLE THERMOSENSITIVE COLORING COMPOSITION AND A THERMOSENSITIVE RECORDING MEDIUM USING THEREOF

BACKGROUND OF THE INVENTION

1. Field of the Invention

The present invention generally relates to a reversible thermosensitive coloring composition and a thermosensitive recording medium using thereof, and more particularly to a reversible thermosensitive coloring composition and a thermosensitive recording medium using thereof in which a coloring reaction between an electron donating chromophoric compound and an electron accepting compound is utilized.

2. Description of the Related Art

Currently, a reversible thermosensitive coloring composition which is easily colored and decolorized repeatedly has been developed.

In such a reversible thermosensitive coloring composition, a coloring reaction and a decolorizing reaction between an electron donating chromophoric compound (hereinafter, referred to as a chromophoric agent or leuco dye) and an electron accepting compound (hereinafter, referred to as a developer) are utilized. For example, Japanese Laid-Open Patent Application No. 5-124360 discloses that an organic phosphoric acid compound, a fatty carboxylic acid oxide or a phenol compound can be used as the developer. Japanese Laid-Open Patent Application No. 6-210954 discloses a phenol compound having a specific long chain fatty group hydrocarbon as the developer. These compounds enable the coloring and the decolorizing by controlling a temperature.

However, the reversible thermal recording medium utilizing the reversible thermosensitive compound is not suitable for use when exposed by light. When the colored recoding medium is exposed by light, a color concentration thereof is not decreased to that of a blank zone even if the decolorizing process is conducted by heating. That is, problems exist in light-resisting characteristics in that the decolorizing is not adequate, the color appearance is changed or the decolorized blank zone gets colorful.

We have proposed in Japanese Laid-Open Patent Applications Nos. 6-1066 and 6-155907 that an antioxidant or guanidine derivatives should be added to the recording layer in order to improve light-resisting characteristics. However, by an addition of such additive, an adequate decolorizing cannot be obtained. Further, an excess amount of such additive adversely influences the coloring after exposure. Moreover, the light-resisting characteristics are generally required to be improved.

SUMMARY OF THE INVENTION

Accordingly, it is a general object of the present invention to provide a novel and useful reversible thermosensitive coloring composition and a thermosensitive recording medium which have high light-resisting characteristics and the coloring and the decolorizing can be repeated suitably.

The above object of the present invention is achieved by a reversible thermosensitive coloring composition comprising an electron donating chromophoric compound and an electron accepting compound, which has a colored state and a decolorized state based on a heated temperature and a difference of cooling speed after heated, the electron donating chromophoric compound include a compound having a general formula (I),

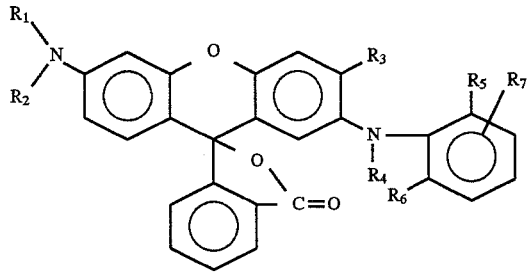

(I)

wherein $R_1$ represents a hydrogen atom or a $C_1$-$C_4$ alkyl group; $R_2$ represents a $C_1$-$C_6$ linear or branched alkyl group, a cycloalkyl group, a tetrahydrofurfuryl group or a substituted or unsubstituted phenyl group; $R_3$ represents a hydrogen atom, a $C_1$-$C_2$ alkyl group, an alkoxy group or a halogen atom; $R_4$ represents a $C_1$-$C_4$ alkyl group; at least one of $R_5$ and $R_6$ represents a methyl group, an ethyl group, a methoxy group or a halogen atom; $R_7$ represents a hydrogen atom, a methyl group, an acetyl group or a halogen atom, and when both $R_5$ and $R_6$ represent a halogen, $R_7$ is not a hydrogen atom.

In the above invention, the electron accepting compound may include a developing structure and an aliphatic structure, the developing structure being selected from the group consisting of an organic phosphoric acid, an aliphatic carboxylic acid and a phenol compound, the aliphatic structure being selected from the group consisting of an alkyl group and an alkenyl group.

The above invention may further include a guanidine compound.

In the above invention, the guanidine compound may have one of general formulae (XVI) and (XVII).

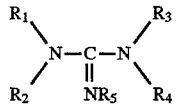

(XVI)

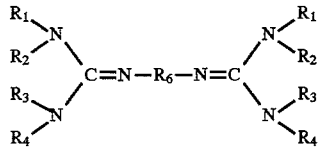

(XVII)

wherein $R_1$, $R_2$, $R_3$, $R_4$ and $R_5$ represent an alkyl group, a cyclic alkyl group, an aryl group, an acyl group or an acylamino group, $R_6$ represents a low alkylene group, a phenylene group, a naphthylene group and a group having a general formula (XVIII),

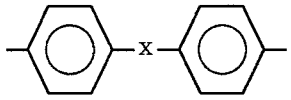

(XVIII)

in which X represents —$SO_2$—, —S—S—, —S—, —O—, —NH— or single bond.

The above object of the present invention is also achieved by a reversible thermal recording medium comprising a support and a thermosensitive recording layer including a reversible thermosensitive coloring composition, wherein the reversible thermosensitive coloring composition comprises an electron donating chromophoric compound and an electron accepting compound, which has a colored state and a decolorized state based on a heated temperature and a difference of cooling speed after heated, the electron donating chromophoric compound include a compound having a general formula (I),

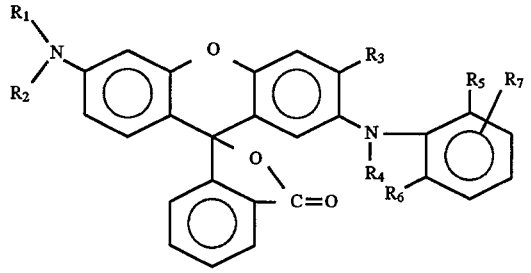

(I)

wherein $R_1$ represents a hydrogen atom or a $C_1$-$C_4$ alkyl group; $R_2$ represents a $C_1$-$C_6$ linear or branched alkyl group, a cycloalkyl group, a tetrahydrofurfuryl group or a substituted or unsubstituted phenyl group; $R_3$ represents a hydrogen atom, a $C_1$-$C_2$ alkyl group, an alkoxy group or a halogen atom; $R_4$ represents a $C_1$-$C_4$ alkyl group; at least one of $R_5$ and $R_6$ represents a methyl group, an ethyl group, a methoxy group or a halogen atom; $R_7$ represents a hydrogen atom, a methyl group, an acetyl group or a halogen atom, and when both $R_5$ and $R_6$ represent a halogen, $R_7$ is not a hydrogen atom.

The above invention may further include an oxygen barrier layer provided on the thermal recording layer.

The reversible thermosensitive coloring composition of the present invention can form the colored state and the uncolorized state based on a heated temperature and a cooling speed. Hereinafter, the coloring and decolorizing mechanisms will be described with reference to FIG. 1.

FIG. 1 is a graph showing coloring-decolorizing characteristics of the reversible thermosensitive coloring composition. When the composition in an uncolored state (A) is increased in temperature, a coloring occurs and the composition in a colored-melting state (B) is obtained at a melting point T1. When the composition in the colored-melting state (B) is rapidly cooled to a room temperature, the composition in a colored-solid state (C) is obtained. Whether the composition in the colored-solid state (C) is obtained or not depends on a decreasing speed of the temperature from the colored-melting state (B). When the composition in the colored-melting state (B) is cooled gradually, the color disappears during a cooling process and the initial colorless state (A) or a low-concentration state which has a lower concentration than the colored-solid state (C) is obtained. On the other hand, when the composition in the colored-solid state (C) is heated again, a decolorizing occurs at a temperature T2 which is lower than the coloring temperature (from D to E). When the composition in this state is cooled, the initial uncolored state is obtained. The coloring temperature and the decolorizing temperature depend on a combination of the chromophoric agent and the developing agent, which can be selected from a wide variety thereof. The color concentration of the colored-melting state is not always equal to the color concentration after being cooled rapidly.

In the composition of the present invention, the developer and the chromophoric agent are mixed such that molecules thereof are contactable and the state is probably solid. In this state, the developer and the chromophoric agent are aggregated to maintain the coloring. The aggregation is considered to stabilize the coloring state. On the other hand, in the decolorized state, both components are separated in different phases. In this state, molecules of at least one component are ensembled to form domains or crystals. By the aggregation or the crystallization of the molecules of at least one component, the developer and the chromophoric agent are separated to be stabilized. In the present invention, most probably, when the developer and the chromophoric agent are separated in the different phases and the developer is crystallized, a complete uncolorized state can be realized. The decolorizing due to the gradual cooling of a melting state and the heating of the colored state are based on a change in the aggregation, the phase separation and the crystallization of the developer.

In the reversible thermosensitive recording medium of the present invention, a recording is conducted by heating a recording layer to its melting point by, for example, a thermal head and then cooling it rapidly. In order to decolorize the image formed, the heated recording layer is gradually cooled or is heated to just below the coloring temperature. However, these methods are the same in that the components are temporarily maintained at a temperature at which both the components are separated or at least one of them is crystallized. The reason for cooling the recording layer rapidly to form coloring is to prevent maintaining a temperature at which the phase separation or the crystallization occurs. In this disclosure, "gradually cool" and "rapidly cool" are relative concepts and a border therebetween depends on the combination of the chromophoric agent and the developer.

One of the features of the present invention is that a fluoran compound having a general formula (I) is included in the electron donating chromophoric compound as the coloring agent. By this feature, even when the image is exposed by light, a clear decolorized state is obtained and the light-resisting characteristics can be improved.

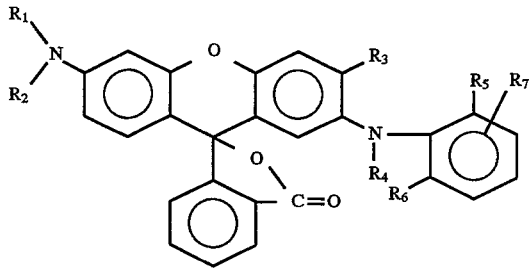

(I)

(In the above formula, $R_1$ represents a hydrogen atom or a $C_1$-$C_4$ alkyl group; $R_2$ represents a $C_1$-$C_6$ linear or branched alkyl group, a cycloalkyl group, a tetrahydrofurfuryl group or a substituted or unsubstituted phenyl group; $R_3$ represents a hydrogen atom, a $C_1$-$C_2$ alkyl group, an alkoxy group or a halogen atom; $R_4$ represents a $C_1$-$C_4$ alkyl group; at least one of $R_5$ and $R_6$ represents a methyl group, an ethyl group, a methoxy group or a halogen atom; $R_7$ represents a hydrogen atom, a methyl group, an acetyl group or a halogen atom, and when both $R_5$ and $R_6$ represent a halogen, $R_7$ is not a hydrogen atom.)

The fluoran compound may be used solely. Also, it may be used with other chromophoric agents if necessary. In this case, it is preferred that a content of the fluoran compound is more than 50w %.

Examples of the fluoran compound which can be used in the present invention include, but are not limited to, 2-(N-methyl-o-chloroanilino)-6-n-dibutylaminofluoran, 2-(N-ethyl-o-chloroanilino)-6-n-dibutylaminofluoran, 2-(N-n-propyl-o-chloroanilino)-6-n-dibutylaminofluoran, 2-(N-n-butyl-o-chloroanilino)-6-n-dibutylaminofluoran, 2-(N-methyl-o-chloroanilino)-3-methyl-6-N-ethyl-p-toluidilaminofluoran, 2-(N-methyl-O-chloroanilino)-6-N-ethyl-N-p-toluidilaminofluoran, 2-(N-methyl-o-chloroanilino)-3-methyl-6-N-n-dibutylaminofluoran, 2-(N-methyl-o-methylanilino)-6-N-n-dibutylaminofluoran, 2-(N-methyl-o-methylanilino)-3-ethyl-6-N-n-dibutylaminofluoran, 2-(N-n-butyl-o-chloroanilino)-6-N-ethyl-N-p-toluidilaminofluoran, 2-(N-n-butyl-o-chloroanilino)-6-N-ethyl-N-p-toluidilaminofluoran, 2-(N-methyl-o-chloroanilino)-6-N-ethyl-N-isobutylaminofluoran, 2-(N-methyl-o-chloroanilino)-6-N-ethyl-N-tetrahydrofurfurylaminofluoran, 2-(N-methyl-o-chloroanilino)-6-N-ethyl-N-isoamylaminofluoran, 2-(N-methyl-2',6'-dimethylanilino)-6-N-n-dibutylaminofluoran, 2-(N-methyl-2',6'-dimethylanilino)-6-N-ethyl-N-p-toluidilaminofluoran, 2-(N-methyl-2',4',6'-trimethylanilino)-6-N-ethyl-N-p-toluidilaminofluoran and 2-(N-methyl-2',4',6'-trichloroanilino)-6-N-n-dibutylaminofluoran, The fluoran compound used in the present invention can be prepared by conventional processes disclosed in, for example, Japanese Laid-Open Patent Applications Nos. 1-198385 and 6-286302. That is, a compound having a general formula (II) or (III) is coupled by treating with a dehydration agent such as concentrated sulfuric acid and treated with an alkali aqueous solution such as sodium hydroxide solution.

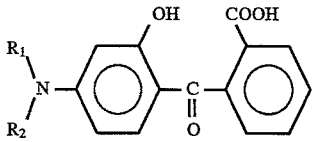

(II)

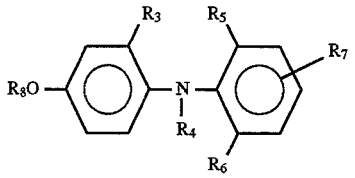

(III)

(In general formulae (II) and (III), $R_1$-$R_7$ represent the same as those in the general formula (I) and $R_8$ represents an alkyl group.)

Also, the compound having a general formula (III) can be prepared by reacting a compound having a general formula (IV) with $R_4X$, $(R_4O)_3PO$ $(R_4)_2SO_4$ or a compound having a general formula (V), in which $R_4$ represents the same as that previously mentioned and X represents a halogen atom.

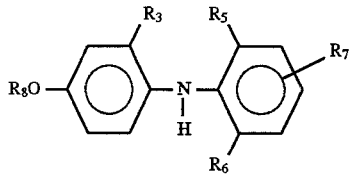

(IV)

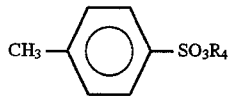

(V)

The electron accepting compound as the developer has a developing structure which develops the coloring agent and a long aliphatic structure which controls an aggregation between molecules. As the developing structure, an organic phosphoric acid compound, an aliphatic carboxylic acid and phenol can be listed. The long aliphatic structure is a linear or branched alkyl or alkenyl group, which may have a substituent such as a halogen atom, an alkoxy group or an ester group.

The organic phosphoric acid compound has a general formula (VI), $$R_1—PO(OH)_2 \quad (VI)$$

in which $R_1$ is an aliphatic group.

Examples of the organic phosphoric acid compound include, but are not limited to, dodecylphosphonic acid, tetradecylphosphonic acid, hexadecylphosphonic acid, octadecylphosphonic acid, eicosylphosphonic acid, docosylphosphonic acid, tetracosylphosphonic acid, hexacosylphosphonic acid and octacosylphosphonic acid.

As the aliphatic carboxylic acid compound, α-hydroxyaliphatic carboxylic acid may be used, which has a general formula (VII), $$R_2—CH(OH)—COOH \quad (VII)$$

in which $R_2$ is an aliphatic group having more than 12 carbon atoms.

Examples of the aliphatic carboxylic acid compound include, but are not limited to, α-hydroxydodecanoic acid, α-hydroxytetradecanoic acid, α-hydroxyhexadecanoic acid, α-hydroxyoctadecanoic acid, α-hydroxypentadecanoic acid, α-hydroxyeicosanoic acid, α-hydroxydocosanoic acid, α-hydroxytetracosanoic acid, α-hydroxyhexacosanoic acid and α-hydroxyoctacoic acid.

Also, as the aliphatic carboxylic acid, an aliphatic carboxylic acid compound having more than 12 carbon atoms and a halogen atom at an α or β position can be used.

Examples of the aliphatic carboxylic acid include, but are not limited to, 2-bromohexadecanoic acid, 2-bromoheptadecanoic acid, 2-bromooctadecanoic acid, 2-bromoeicosanoic acid, 2-bromodocosanoic acid, 2-bromotetracosanoic acid, 3-bromoeicosanoic acid, 3-bromooctadecanoic acid, 2,3-dibromooctadecanoic acid, 2-fluorododecanoic acid, 2-fluorotetradecanoic acid, 2-fluorohexadecanoic acid, 2-fluorooctadecanoic acid, 2-fluoroeicosanoic acid, 2-fluorodocosanoic acid, 2-iodohexadecanoic acid, 2-iodooctadecanoic acid, 3-iodohexadecanoic acid, 3-iodooctadecanoic acid and perfluorooctadecanoic acid.

As the aliphatic carboxylic acid compound, an aliphatic carboxylic acid compound having more than 12 carbon atoms, in which a carbon chain has oxo groups and at least carbon atoms at α, β and Γ positions are oxo groups, can be used.

Examples of the compound include, but are not limited to, 2-oxododecanoic acid, 2-oxotetradecanoic acid, 2-oxohexadecanoic acid, 2-oxooctadecanoic acid, 2-oxodoeicosanoic acid, 2-oxotetrscosanoic acid, 3-oxododecanoic acid, 3-oxotetradecanoic acid, 3-oxohexadecanoic acid, 3-oxooctadecanoic acid, 3-oxoeicosanoic acid, 3-oxotetracosanoic acid, 4-oxohexadeconoic acid, 4-oxooctadecanoic acid and 4-oxodocosanoic acid.

As the aliphatic carboxylic acid compound, a 2-base acid having a following formula (VIII) can be used.

$$R_3—X_n—\underset{\underset{CH_2—COOH}{|}}{CH}—COOH \quad (VIII)$$

(In the above formula(VIII), $R_3$ represents an aliphatic group having more than 12 carbon atoms, X represents an oxygen or a sulfur atom and n represents 1 or 2.)

Examples of the above compound include, but are not limited to, dodecylmalic acid, tetradecylmalic acid, hexadecylmalic acid, octadecylmalic acid, eicosylmalic acid, docosylmalic acid, tetcocylmalic acid, dodecylthiomalic acid, tetradecylthiomalic acid, hexadecylthiomalic acid, octadecylthiomalic acid, eicosylthiomalic acid, docosylthiomalic acid, tetracocylthiomalic acid, dodecyldithiomalic acid, tetradecyldithiomalic acid, hexadecyldithiomalic acid, octadecyldithiomalic acid, eicosyldithiomalic acid, docosyldithiomalic acid and tetracocyldithiomalic acid.

As the aliphatic carboxylic acid compound, a 2-base acid having a following formula (IX) can be used.

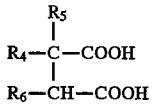

(IX)

(In the above formula (V), $R_4$, $R_5$ and $R_6$ represent a hydrogen or an aliphatic group and at least one of them is an aliphatic group having more than 12 carbon atoms.)

Examples of the above compound include, but are not limited to, dodecyldibutanoic acid, tridecyldibutanoic acid, tetradecyldibutanoic acid, pentadecyldibutanoic acid, octadecyldibutanoic acid, eicosyldibutanoic acid, docosyldibutanoic acid, 2,3-dihexadecyldibutanoic acid, 2,3-dioctadecyldibutanoic acid, 2-methyl-3-dodecyldibutanoic acid, 2-methyl-3-tetradecyldibutanoic acid, 2-methyl-3-hexadecyldibutanoic acid, 2-ethyl-3-dodecyldibutanoic acid, 2-propyl-3-decyldibutanoic acid, 2-octyl-3-hexadecyldibutanoic acid and 2-tetradecyl-3-octadecyldibutanoic acid.

As the aliphatic carboxylic acid compound, 2-base acid having a following formula (X) can be used.

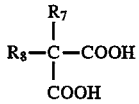

(X)

(In the above formula (VI), $R_7$ and $R_8$ represent a hydrogen atom or an aliphatic group and at least one of them is an aliphatic group having more than 12 carbon atoms.)

Examples of the above compound include, but are not limited to, dodecylmalonic acid, tetradecylmalonic acid, hexadecylmalonic acid, octadecylmalonic acid, eicosylmalonic acid, docosylmalonic acid, tetracosylmalonic acid, didodecylmalonic acid, ditetradecylmalonic acid, dihexadecylmalonic acid, dioctadecylmalonic acid, dieicosylmalonic acid, didocosylmalonic acid, methyoctadecylmalonic acid, methyleicosylmalonic acid, methyldocosylmalonic acid, methyltetracocylmalonic acid, ethyoctadecylmalonic acid, ethyleicosylmalonic acid, ethyldocosylmalonic acid and ethyltetracocylmalonic acid.

As the aliphatic carboxylic acid compound, an acid having a following formula (XI) can be used.

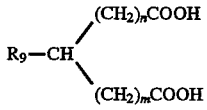

(XI)

(In the above formula (VII), $R_9$ represents an aliphatic group having more than 12 carbon atoms, n represents 0 or 1 and m represents 1, 2 or 3, wherein when n is 0, m represent 2 or 3, and when n is 1, m represents 1 or 2.)

Examples of the above compound include, but are not limited to, 2-dodecyldipentanoic acid, 2-hexadecyldipentanoic acid, 2-octadecyldipentanoic acid, 2-eicosyldipentanoic acid, 2-docosyldipentanoic acid, 2-dodecyldihexanoic acid, 2-pentadecyldihexanoic acid, 2-octadecyldihexanoic acid, 2-eicosyldihexanoic acid and 2-docosyldihexanoic acid.

As the aliphatic carboxylic acid compound, a citric acid acylated by a higher fatty acid such as compound (XII), (XIII) or (XIV) can be used.

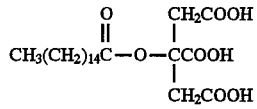

(XII)

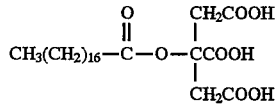

(XIII)

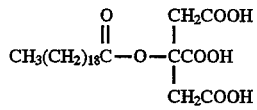

(XIV)

As the phenol compound, compounds having a following general formula (XV) can be used.

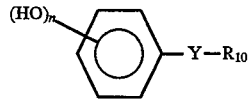

(XV)

(In the above formula (VI), Y represents —S—, —O—, —CONH, —NHCO—, —NHCONH—, $NHSO_2$—, —CH=CH—CONH— or —COO—, $R_{10}$ represents an aliphatic group having more than 12 carbon atoms and n is 1, 2 or 3.)

Examples of the above compound include, but are not limited to, p-(dodecylthio)phenol, p-(tetradecylthio)phenol, p-(hexadecylthio)phenol, p-(octadecylthio)phenol, p-(eicosylthio)phenol, p-(docosylthio)phenol, p-(tetracosylthio)phenol, p-(dodecyloxy)phenol, p-(tetradecyloxy)phenol, p-(hexadecyloxy)phenol, p-(octadecyloxy)phenol, p-(eicosyloxy)phenol, p-(docosyloxy)phenol, p-(tetracosyloxy)phenol, p-dodecylcarbamoylphenol, p-tetradecylcarbamoylphenol, p-hexadecylcarbamoylphenol, p-octadecylcarbamoylphenol, p-eicosylcarbamoylphenol, p-docosylcarbamoylphenol, p-tetracosylcarbamoylphenol, hexadecyl gallate ester, octadecyl gallate ester, eicosyl gallate ester, docosyl gallate ester, tetracocyl gallate ester, 4'-hydroxytridecaneanilide, 4'-hydroxyheptadecaneanilide, 4'-hydroxynonadecaneanilide, 3'-hydroxynonadecaneanilide, 4'-hydroxydocosaneanilide, 4-(N-dodecylsulfonylamino)phenol, 4-(N-octadecylsulfonylamino)phenol, N-(4-hydroxyphenyl)-N'-dodecylurea, N-(4-hydroxyphenyl)-N'-octadecylurea, N-(4-hydroxyphenyl)-N'-docosylurea, N-dodecyl-P-hydroxycinnamamide, N-octadecyl-P-hydroxycinnamamide, N-docosyl-P-hydroxycinnamamide and N-octacocyl-P-hydroxycinnamamide.

A ratio of the coloring agent to the developer in the thermosensitive coloring composition of the present invention depends on compounds used. Generally, the ratio is 1–20 parts, preferably 2–10 parts of coloring agent per 1 part of the developer based on a molecule amount. Outside of the range, the color concentration appearing is low.

By an addition of a guanidine compound, the blank zone concentration will be lowered to obtain an image with a high contrast.

The guanidine compound used has a general formula (XVI) or (XVII).

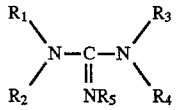

(XVI)

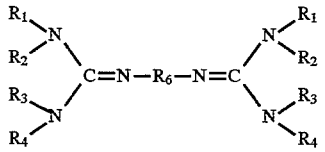

(XVII)

($R_1$, $R_2$, $R_3$, $R_4$ and $R_5$ are an alkyl group, a cyclic alkyl group, an aryl group, an acyl group or an acylamino group. The aryl group may have an alkoxy group, a nitro group, an amino group, an alkylamino group, an acylamino group or a halogen atom. $R_6$ in the formula (XVII) represents a low alkylene group, a phenylene group, a naphthylene group and a group having a general formula (XVIII) in which X represents —$SO_2$—, —S—S—, —S—, —O—, —NH— or single bond.)

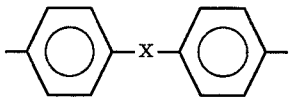

(XVIII)

Ecamples of the guanidine compound include 1,3-dicyclohexylguanidine, 1-benzyl-3-phenylguanidine, 1-phenyl-3-p-tolylguanidine, 1,3-diphenyl-2-p-tolylguanidine, 1,3-diphenyl-2-cyclohexylguanidine, 1,3-dicyclohexyl-2-phenylguanidine, 1,2,3-tricyclohexylguanidine, 1,3-di-p-methoxyphenylguanidine, 1,3-di-p-methoxyphenyl-2-cyclohexylguanidine, 1,3-dicyclohexyl-2-o-tolylguanidine, 1,3-dicyclohexyl-2-(2,4-dimethylphenyl)guanidine, 1,3-dicyclohexyl-2-p-tolylguanidine, 1,3-dicyclohexyl-2-(2,5-dichlorophenyl) guanidine, 1,1-dicyclohexyl-2,3-diphenylguanidine, 1,1-dimethy-3-phenylguanidine, 1,3-diphenylguanidine, 1,3-di-o-tolylguanidine, 1-hexyl-3-phenylguanidine, 1-octadecyl-3-phenylguanidine, 1-benzoyl-3-phenylguanidine, 1,2,3-triphenylguanidine, 1,1,3-triphenylguanidine, 1,2-dibenzoyl-3-phenylguanidine, 1-(o-tolyl)biguanide, p-di(1,3-diphenylguanidino)diphenyl, 1,2-di-(1-phenylguanidino) ethane and di-(1,2,3-triphenylguanidino)methane.

In the present invention, at least one of the above guanidine compounds can be added. An amount thereof is 0.5–100 wt %, preferably, 5–50 wt % to an amount of the coloring agent.

In the reversible thermosensitive coloring composition of the present invention, the thermosensitive recording layer including the reversible thermosensitive coloring composition is provided on the support.

The reversible thermosensitive recording medium has a support and a recording medium provided on the support and including the above composition. The support is not limited to a specific material if the recording layer can be provided on it. Examples of the support include a paper, a resin film, a synthetic paper, a metal foil, glass and a complex thereof.

The recording layer is not limited to the specific composition as long as the composition of the present invention can be contained. However, it is preferred that the chromophoric agent and the developer are dispersed in a binder resin homogeneously. Each of the chromophoric agent and the developer may be prepared as an independent particle. However, it is preferred that the chromophoric agent and the developer are prepared in a complex particle form which is dispersed, The complex particle is obtained by the chromophoric agent and the developer being devolved melted together. The recording layer may be prepared by applying a mixture of a dispersion of each compound to the support and the mixture being dried. Also, the recording layer may be prepared by applying a liquid in which each component is dispersed to the support. Both the chromophoric agent and the developer can be contained in the same micro-capsules.

The reversible thermosensitive recording medium of the present invention may include various additives in order to improve various properties such as applying characteristics of the recording layer and decolorizing characteristics of the recording layer, if necessary. Examples of the additives include, but are not limited to, a decolorizing promoter, an image stabilizer, an antioxidant, a UV absorber, a light stabilizer, a lubricating agent, a filler, a surfactant and a dispersing agent.

Examples of the binder resin used in the recording layer include, but are not limited to, poly (vinyl chloride), poly (vinyl acetate), vinyl chloride-vinylacetate copolymer, ethyl cellulose, polystyrene, styrene copolymer, phenoxy resin, polyester, aromatic polyester, polyurethane, polycarbonate, poly (acrylic ester), polymethacrylate, acrylic acid copolymer, maleic acid copolymer, poly (vinyl alcohol), denatured poly (vinyl alcohol), hydroxyethyl cellulose, carboxymethyl cellulose and starch. The binder resin helps to disperse each element of the composition homogeneously when the heat is applied to delete the record. Therefore, as the binder resin, a heat resisting resin is preferred. The binder resin may preferably be cross-linked by applying heat, UV light or an electron beam.

In the reversible thermosensitive recording medium, an oxygen barrier layer may preferably be provided on the thermal recording layer which prevents the recording layer from being exposed to oxygen. By this feature, a reversible thermosensitive recording medium of higher light-resisting characteristics can be obtained.

As the oxygen barrier layer, a macromolecule film of high visible radiation transmission is preferred. The oxygen barrier layer is selected in view of an oxygen transmission, a transparency, applying characteristics, adhesive characteristics and so on.

Examples of the oxygen barrier layer includes, but are not limited to, poly (alkyl acrylate) such as poly (methyl acrylate), poly (ethyl acrylate) and poly (butyl acrylate), poly (alkyl methacrylate) such as poly (methyl methacrylate) and poly (ethyl methacrylate), polymethacrylonitrile, poly (alkyl vinyl ester) such as poly (vinyl acetate), poly (vinyl propionate), poly (vinyl ethyl butylate) and poly (vinyl phenyl acetate), poly (alkyl vinyl ether) such as poly (methyl vinyl ether), poly (butyl vinyl ether) and poly (chloroethyl vinyl ether), poly (vinyl fluoride), polystyrene, vinyl acetate copolymer, cellulose acetate such as diacetyl cellulose and triacetyl cellulose, fluororesin, polycarbonate, polysaccharide, purane, cellophane, poly (vinyl alcohol), poly (vinylidene chloride), poly (vinyl chloride), acetonitrile copolymer, vinylidene chloride copolymer, poly (chlorotrifluoroethylene), ethylene-vinyl alcohol copolymer, polyacrylonitrile, acrylonitrile copolymer, poly (ethyleneterephthalate), polyester, nylon-6, poly (m-xylene adipamide) and polyacetal.

The oxygen barrier layer in the present invention may be formed by, for example, an extrusion method, a coating method or a lamination method, but is not limited to those. A thickness of the oxygen barrier layer depends on the oxygen transmission characteristics of the resin, but is preferably 0.1–5.0 μm. If the oxygen barrier layer is thinner than that, oxygen barrier characteristics are not adequate. If it is thicker than that, thermosensitive characteristics of the recoding layer are lowered.

In the reversible thermosensitive recording medium of the present invention, the recording layer and the oxygen barrier layer are provided on the support. In order to improve various characteristics of the recording medium, a protective layer, an undercoating layer or a backcoating layer can be provided.

In a printing using the thermal head, a surface of the recording layer is often deformed and has recessed portions due to heat and pressure applied. In order to prevent the deformation, it is preferred that the protective layer is provided on the recording layer. Examples of the recording layer include, but are not limited to, poly (vinyl alcohol), styrene-maleic anhydride copolymer, carboxyl denatured polyethylene, melamine-formaldehyde resin, urea-formaldehyde resin, a UV-setting resin and an electron beam setting resin. The protective layer may include additives such as a UV absorber.

In order to utilize the heat applied, a heat insulating undercoating layer may be provided between the support and the recording layer. The heat insulating layer can be formed by, for example, applying organic or inorganic hollow particles using a binder resin. The undercoating layer can be provided for different purposes, for example, improving adhesive strength between the support and the recording layer and preventing the recording layer from infiltrating the support.

Other objects and further features of the present invention will be apparent from the following description.

DESCRIPTION OF THE PREFERRED EXAMPLES

Figure 1:
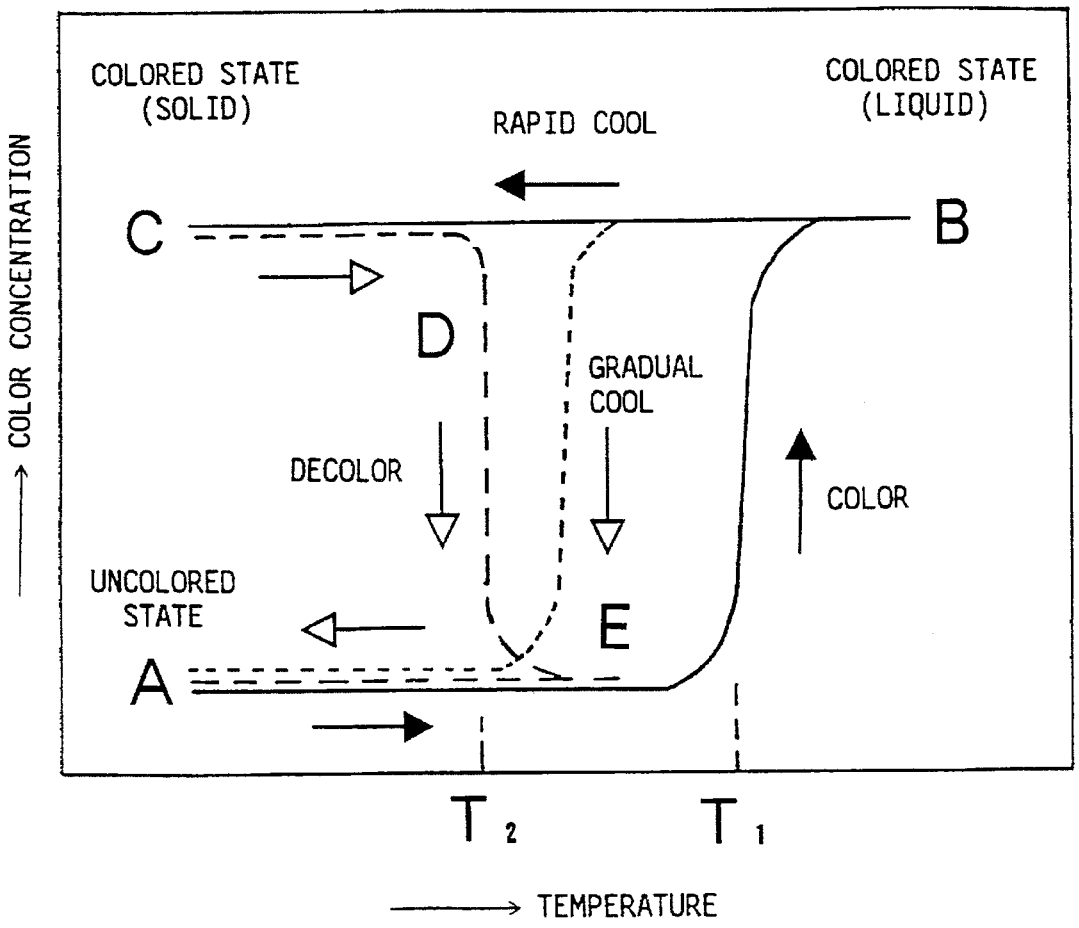
FIG. 1 is a graph showing coloring-decolorizing characteristics of a reversible thermosensitive coloring composition.

The preferred examples of the present invention will now be described. Reversible thermosensitive recording media of the present invention were prepared as follows.

EXAMPLE 1

[Preparation of Recording Layer]

A recording layer liquid having the following composition was prepared. The prepared recording layer liquid was applied to a polyester film of about 100 μm in thickness using a wire-bar. The applied recording layer liquid was dried at 150° C. to obtain a colored recording layer. The colored recording layer was decolorized by leaving it at 80° C. for 10 minutes to obtain a reversible thermosensitive recording medium.

| | |
|---|---|
| Docosyl phosphoric acid | 18 parts |
| 2-(N-n-butyl-o-chloroanilino)-6-N-n-dibutylaminofluoran | 5 parts |
| Vinyl chloride-vinyl acetate copolymer (Union Carbide Inc., VYHH) | 33 parts |
| 3,4-dihydro-2H-pyran | 225 parts |

[Preparation of Protective Layer]

A protective layer composition having the following composition was prepared. The prepared composition was applied on the recording layer of the reversible thermosensitive recording medium using a 0.2-mm wire-bar. After the applied composition was dried at 70° C. for 3 minutes, it was exposed by a 80 W/cm UV lamp to be cured to prepare a protective layer of the reversible thermosensitive recording medium.

| | |
|---|---|
| Butyl acetate solution of urethane acrylate UV-setting resin (75%) (Dainihon Ink Inc. Unidic C7-157) | 150 parts |
| Calcium carbonate (Shiraishi Calcium Inc., Calright SA) | 2 parts |
| Polyethylene wax | 1 parts |
| Methyl ethyl ketone | 50 parts |
| 2-hydroxy-4-n-octoxybenzophenon | 8 parts |

EXAMPLE 2

A reversible thermosensitive recording medium was prepared in the same manner as that in EXAMPLE 1 except that 2-(N-n-butyl-o-chloroanilino)-6-N-n-dibutylaminofluoran as a chromophoric agent was replaced by 2-(N-methyl-o-chloroanilino)-6-N-n-dibutylaminofluoran.

EXAMPLE 3

A reversible thermosensitive recording medium was prepared in the same manner as that in EXAMPLE 1 except that the recording layer liquid has the following composition.

| | |
|---|---|
| Docosyl phosphoric acid | 18 parts |
| 2-(N-n-butyl-o-chloroanilino)-6-N-n-dibutylaminofluoran | 5 parts |
| Vinyl chloride-vinyl acetate copolymer (Union Carbide Inc., VYHH) | 33 parts |
| 3,4-dihydro-2H-pyran | 225 parts |
| 1,3-dicyclohexyl-2-(2,5-dichlorophenyl) guanidine | 0.5 parts |

EXAMPLE 4

A reversible thermosensitive recording medium was prepared in the same manner as that in EXAMPLE 3 except that 2-(N-n-butyl-o-chloroanilino)-6-N-n-dibutylaminofluoran as a chromophoric agent was replaced by 2-(N-methyl-o-chloroanilino)-6-N-n-dibutylaminofluoran.

EXAMPLE 5

A reversible thermosensitive recording medium was prepared in the same manner as that in EXAMPLE 3 except that 2-(N-n-butyl-o-chloroanilino)-6-N-n-dibutylaminofluoran as a chromophoric agent was replaced by 2-(N-n-butyl-o-chloroanilino)-6-N-ethyl-N-p-toluidilaminofluoran.

EXAMPLE 6

A reversible thermosensitive recording medium was prepared in the same manner as that in EXAMPLE 3 except that 2-(N-n-butyl-o-chloroanilino)-6-N-n-dibutylaminofluoran as a chromophoric agent was replaced by 2-(N-methyl-o-chloroanilino)-6-N-ethyl-N-isobutylaminofluoran.

EXAMPLE 7

A reversible thermosensitive recording medium was prepared in the same manner as that in EXAMPLE 3 except that 2-(N-n-butyl-o-chloroanilino)-6-N-n-dibutylaminofluoran as a chromophoric agent was replaced by 2-(N-methyl-o-chloroanilino)-6-N-ethyl-N-tetrahydrofurfurylaminofluoran.

EXAMPLE 8

A reversible thermosensitive recording medium was prepared in the same manner as that in EXAMPLE 3 except that 2-(N-n-butyl-o-chloroanilino)-6-N-n-dibutylaminofluoran as a chromophoric agent was replaced by 2-(N-methyl-o-chloroanilino)-6-N-n-dipropylaminofluoran.

EXAMPLE 9

A reversible thermosensitive recording medium was prepared in the same manner as that in EXAMPLE 3 except that 2-(N-n-butyl-o-chloroanilino)-6-N-n-dibutylaminofluoran as a chromophoric agent was replaced by 2-(N-methyl-o-chloroanilino)-6-N-ethyl-N-isoamylaminofluoran.

EXAMPLE 10

A reversible thermosensitive recording medium was prepared in the same manner as that in EXAMPLE 3 except that 2-(N-n-butyl-o-chloroanilino)-6-N-n-dibutylaminofluoran as a chromophoric agent was replaced by 2-(N-methyl-o-chloroanilino)-6-N-ethyl-N-p-toluidilaminofluoran.

EXAMPLE 11

A recording layer of a reversible thermosensitive recording medium was formed in the same manner as that in EXAMPLE 1. An oxygen barrier layer was prepared as follows.

[Preparation of Oxygen Barrier Layer]

On the recording layer of the reversible thermosensitive recording medium, a 10% aqueous solution of poly (vinyl alcohol) was applied using a 0.2-mm wire-bar. The applied solution was dried at 70° C. for 3 minutes to prepare an oxygen barrier layer.

A protective layer was formed on the oxygen barrier layer in the same manner as that in EXAMPLE 1.

EXAMPLE 12

A recording layer was formed in the same manner as that in EXAMPLE 2. After that, an oxygen barrier layer and a protective layer were prepared in the same manner as that in EXAMPLE 11 to obtain a reversible thermosensitive recording medium.

EXAMPLE 13

A recording layer was formed in the same manner as that in EXAMPLE 3. After that, an oxygen barrier layer and a protective layer were prepared in the same manner as that in EXAMPLE 11 to obtain a reversible thermosensitive recording medium.

EXAMPLE 14

A recording layer was formed in the same manner as that in EXAMPLE 4. After that, an oxygen barrier layer and a protective layer were prepared in the same manner as that in EXAMPLE 11 to obtain a reversible thermosensitive recording medium.

EXAMPLE 15

A recording layer was formed in the same manner as that in EXAMPLE 5. After that, an oxygen barrier layer and a protective layer were prepared in the same manner as that in EXAMPLE 11 to obtain a reversible thermosensitive recording medium.

EXAMPLE 16

A recording layer was formed in the same manner as that in EXAMPLE 6. After that, an oxygen barrier layer and a protective layer were prepared in the same manner as that in EXAMPLE 11 to obtain a reversible thermosensitive recording medium.

EXAMPLE 17

A recording layer was formed in the same manner as that in EXAMPLE 7. After that, an oxygen barrier layer and a protective layer were prepared in the same manner as that in EXAMPLE 11 to obtain a reversible thermosensitive recording medium.

EXAMPLE 18

A recording layer was formed in the same manner as that in EXAMPLE 8. After that, an oxygen barrier layer and a protective layer were prepared in the same manner as that in EXAMPLE 11 to obtain a reversible thermosensitive recording medium.

EXAMPLE 19

A recording layer was formed in the same manner as that in EXAMPLE 9. After that, an oxygen barrier layer and a protective layer were prepared in the same manner as that in EXAMPLE 11 to obtain a reversible thermosensitive recording medium.

EXAMPLE 20

A recording layer was formed in the same manner as that in EXAMPLE 10. After that, an oxygen barrier layer and a protective layer were prepared in the same manner as that in EXAMPLE 11 to obtain a reversible thermosensitive recording medium.

In order to conduct a comparison test, the following COMPARATIVE EXAMPLES are prepared as follows.

COMPARATIVE EXAMPLE 1

A reversible thermosensitive recording medium was prepared in the same manner as that in EXAMPLE 3 except that 2-(N-n-butyl-o-chloroanilino)-6-N-n-dibutylaminofluoran as a chromophoric agent was replaced by 2-(N-chloroanilino)-6-N-n-dibutylaminofluoran.

COMPARATIVE EXAMPLE 2

A recording layer was prepared in the same manner as that in COMPARATIVE EXAMPLE 1. After that, an oxygen barrier layer and a protective layer were prepared in the same manner as that in EXAMPLE 11 to obtain a reversible thermosensitive recording medium.

COMPARATIVE TESTS

In order to establish a benefit of the present invention, the following tests were conducted.

On each of the prepared reversible thermosensitive recording media of EXAMPLE and COMPARATIVE EXAMPLE, an image was formed by using a printing device having a thermal head (head:8 dots/mm, applied voltage:13.3 volts, pulse width:0.8 ms).

The color concentrations of the recording layer of various states were measured by a Macbeth Illuminometer RD-918, which includes an initial blank zone concentration before an exposure, an initial color concentration, a color concentration after a 24-hour exposure by a 45001× fluorescent lamp and a decolorized concentration after leaving it in a thermostatic bath at 80° C. for 10 minutes.

The results are shown in TABLE 1.

TABLE 1

| | GUANIDINE[1)] COMPOUND | OXYGEN[2)] BARRIER LAYER | INITIAL BLANK ZONE CONCENTRATION | INITIAL COLOR CONCENTRATION | BLANK ZONE CONCENTRATION AFTER EXPOSURE | COLOR CONCENTRATION AFTER EXPOSURE | DECOLORIZED CONCENTRATION AFTER EXPOSURE | DIFFERENCE[3)] OF DECOLORIZED CONCENTRATION |
|---|---|---|---|---|---|---|---|---|
| EXAMPLE 1 | x | x | 0.21 | 1.24 | 0.21 | 1.26 | 0.32 | +0.11 |
| EXAMPLE 2 | x | x | 0.20 | 1.25 | 0.21 | 1.24 | 0.33 | +0.12 |
| EXAMPLE 3 | o | x | 0.15 | 1.38 | 0.16 | 1.20 | 0.24 | +0.08 |
| EXAMPLE 4 | o | x | 0.15 | 1.37 | 0.16 | 1.29 | 0.26 | +0.10 |
| EXAMPLE 5 | o | x | 0.15 | 1.38 | 0.14 | 1.58 | 0.21 | +0.07 |
| EXAMPLE 6 | o | x | 0.16 | 1.40 | 0.16 | 1.33 | 0.23 | +0.07 |
| EXAMPLE 7 | o | x | 0.16 | 1.84 | 0.17 | 1.90 | 0.25 | +0.08 |
| EXAMPLE 8 | o | x | 0.16 | 1.77 | 0.16 | 1.77 | 0.27 | +0.11 |
| EXAMPLE 9 | o | x | 0.16 | 1.58 | 0.16 | 1.54 | 0.26 | +0.10 |
| EXAMPLE 10 | o | x | 0.09 | 1.38 | 0.10 | 1.38 | 0.21 | +0.11 |
| EXAMPLE 11 | x | o | 0.20 | 1.22 | 0.21 | 1.21 | 0.21 | 0 |
| EXAMPLE 12 | x | o | 0.20 | 1.26 | 0.22 | 1.24 | 0.22 | 0 |
| EXAMPLE 13 | o | o | 0.14 | 1.39 | 0.14 | 1.55 | 0.14 | 0 |
| EXAMPLE 14 | o | o | 0.14 | 1.31 | 0.16 | 1.31 | 0.16 | 0 |
| EXAMPLE 15 | o | o | 0.13 | 1.41 | 0.14 | 1.57 | 0.14 | 0 |
| EXAMPLE 16 | o | o | 0.15 | 1.68 | 0.15 | 1.77 | 0.15 | 0 |
| EXAMPLE 17 | o | o | 0.16 | 1.83 | 0.16 | 1.89 | 0.16 | 0 |
| EXAMPLE 18 | o | o | 0.16 | 1.83 | 0.16 | 1.91 | 0.16 | 0 |
| EXAMPLE 19 | o | o | 0.16 | 1.57 | 0.16 | 1.65 | 0.16 | 0 |
| EXAMPLE 20 | o | o | 0.08 | 1.42 | 0.11 | 1.58 | 0.11 | 0 |
| COMPARATIVE EXAMPLE 1 | o | x | 0.14 | 1.32 | 0.16 | 1.20 | 0.36 | +0.20 |
| COMPARATIVE EXAMPLE 2 | o | o | 0.14 | 1.34 | 0.16 | 1.30 | 0.30 | +0.14 |

[1), 2)] o: PROVIDED
x: NOT PROVIDED

[3)] (DIFFERENCE OF DECOLORIZED CONCENTRATION) = (DECOLORIZED CONCENTRATION AFTER EXPOSURE) − (INITIAL BLANK ZONE CONCENTRATION)

As is understood from the above results, the clear decolorizing states were obtained even after the recording layers were exposed by light and the light-resisting characteristics were improved.

Further, by providing the oxygen layer, the decolorizing states and the light-resisting characteristics were much improved.

It goes without saying that the present invention is not limited to these examples, but various variations and modifications may be made without departing from the scope of the present invention.

What is claimed is:

1. A reversible thermosensitive coloring composition comprising an electron donating chromophoric compound and an electron accepting compound, which has a colored state and a decolorized state based on a heated temperature and a difference between cooling speeds after being heated, said electron donating chromophoric compound including a compound having a general formula (I),

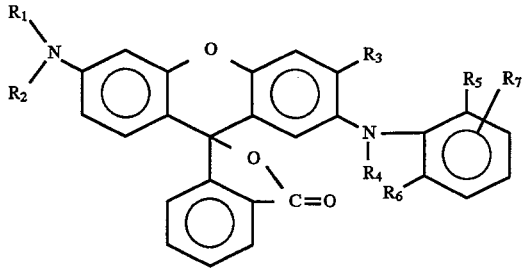

(I)

wherein $R_1$ represents a hydrogen atom or a $C_1$-$C_4$ alkyl group $R_2$ represents a $C_1$-$C_6$ linear or branched alkyl group, a cycloalkyl group, a tetrahydrofurfuryl group or substituted or unsubstituted phenyl group; $R_3$ represents a hydrogen atom, a $C_1$-$C_2$ alkyl group, an alkoxy group or a halogen atom; $R_4$ represents a $C_1$-$C_4$ alkyl group; $R_5$ and $R_6$ each represents hydrogen, a methyl group, an ethyl group, a methoxy group or a halogen atom, and at least one of $R_5$ and $R_6$ represents a methyl group, an ethyl group, a methoxy group or a halogen atom; $R_7$ represents a hydrogen atom, a methyl group, an acetyl group or a halogen atom, and when both $R_5$ and $R_6$ represents a halogen, $R_7$ is not a hydrogen atom.

2. The reversible thermosensitive coloring composition according to claim 1, said electron accepting compound includes a developing structure and an aliphatic structure, said developing structure being selected from the group consisting of an organic phosphoric acid, an aliphatic carboxylic acid and a phenol compound, said aliphatic structure being selected from the group consisting of an alkyl group and an alkenyl group.

3. The reversible thermosensitive coloring composition according to claim 1, further comprising a guanidine compound.

4. The reversible thermosensitive coloring composition according to claim 3, wherein said guanidine compound has one of general formulae (XVI) and (XVII),

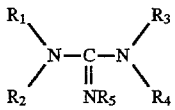

(XVI)

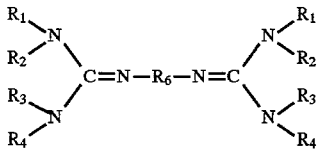

(XVII)

wherein $R_1$, $R_2$, $R_3$, $R_4$ and $R_5$ represent an alkyl group, a cyclic alkyl group, an aryl group, an acyl group or an acylamino group, $R_6$ represents a low alkylene group, a phenylene group, a naphthylene group and a group having a general formula (XVIII),

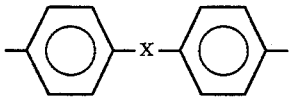

(XVIII)

in which X represents —$SO_2$—, —S—S—, —S—, —O—, —NH— or single bond.

5. A reversible thermal recording medium comprising:

a support; and a thermosensitive recording layer including a reversible thermosensitive color composition;

wherein said reversible thermosensitive coloring composition comprises an electron donating chromophoric compound and an electron accepting compound, which has a colored state and a decolorized state based on a heated temperature and a difference between cooling speeds after being heated, said electron donating chromophoric compound including a compound having a general formula (I),

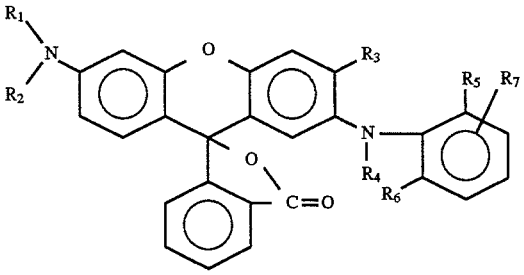

(I)

wherein $R_1$ represents a hydrogen atom or a $C_1$-$C_4$ alkyl group $R_2$ represents a $C_1$-$C_6$ linear or branched alkyl group, a cycloalkyl group, a tetrahydrofurfuryl group or substituted or unsubstituted phenyl group; $R_3$ represents a hydrogen atom, a $C_1$-$C_2$ alkyl group, an alkoxy group or a halogen atom; $R_4$ represents a $C_1$-$C_4$ alkyl group; $R_5$ and $R_6$ each represents hydrogen, a methyl group, an ethyl group, a methoxy group or a halogen atom, and at least one of $R_5$ and $R_6$ represents a methyl group, an ethyl group, a methoxy group or a halogen atom; $R_7$ represents a hydrogen atom, a methyl group, an acetyl group or a halogen atom, and when both $R_5$ and $R_6$ represents a halogen, $R_7$ is not a hydrogen atom.

6. The reversible thermal recording medium according to claim 5 further comprising an oxygen barrier layer provided on said thermal recording layer.

* * * * *